US009030318B1

(12) United States Patent
Baldwin et al.

(10) Patent No.: US 9,030,318 B1
(45) Date of Patent: May 12, 2015

(54) WIRELESS TANDEM ALARM

(71) Applicants: Christopher M. Baldwin, Avon, IN (US); Daniel W. O'Brien, Mooresville, IN (US); Mark T. Monnett, Cloverdale, IN (US)

(72) Inventors: Christopher M. Baldwin, Avon, IN (US); Daniel W. O'Brien, Mooresville, IN (US); Mark T. Monnett, Cloverdale, IN (US)

(73) Assignee: Mallory Sonalert Products, Inc., Indianapolis, IN (US)

( * ) Notice: Subject to any disclaimer, the term of this patent is extended or adjusted under 35 U.S.C. 154(b) by 0 days.

(21) Appl. No.: 13/841,295

(22) Filed: Mar. 15, 2013

(51) Int. Cl.
*G08B 1/08* (2006.01)

(52) U.S. Cl.
CPC ..... *G08B 1/08* (2013.01)

(58) Field of Classification Search
USPC ..... 340/539.1, 531, 539.11, 573.1, 5.21, 340/5.64, 501, 539.12, 568.1, 571, 573.4, 340/539.13, 539.22, 541
See application file for complete search history.

(56) References Cited

U.S. PATENT DOCUMENTS

| | | | |
|---|---|---|---|
| 3,638,223 | A | 1/1972 | Potter |
| 3,815,129 | A | 6/1974 | Sweany |
| 3,922,672 | A | 11/1975 | Birt et al. |
| 4,104,628 | A | 8/1978 | Sweany et al. |
| 4,156,156 | A | 5/1979 | Sweany et al. |
| 4,180,808 | A | 12/1979 | Lebet et al. |
| 4,183,020 | A | 1/1980 | Schade, Jr. |
| 4,213,121 | A | 7/1980 | Learn et al. |
| 4,429,247 | A | 1/1984 | Feldman |
| 4,558,305 | A | 12/1985 | Black et al. |
| 4,626,799 | A | 12/1986 | Matievic |
| 4,697,932 | A | 10/1987 | Matievic |
| 4,700,100 | A | 10/1987 | Congdon et al. |
| 4,719,452 | A | 1/1988 | Logsdon |
| 4,904,982 | A | 2/1990 | Lieb et al. |
| 4,945,346 | A | 7/1990 | Schmiemann |
| 5,083,312 | A | 1/1992 | Newton et al. |

(Continued)

OTHER PUBLICATIONS

MC9S08QD4 Series MCU Data Sheet, Rev. 6, © 2006-2010 Freescale Semiconductor, Inc., 198 pgs.

(Continued)

*Primary Examiner* — Daniel Previl
(74) *Attorney, Agent, or Firm* — William F. Bahret

(57) ABSTRACT

A wireless tandem alarm having a first alarm configured for physical connection to an industrial machine having an electronic machine controller, and a second alarm configured for detachable connection to the first alarm or to the industrial machine. Each alarm has a housing, a piezoelectric transducer within the housing, a processor configured to drive the piezoelectric transducer in response to a control signal, and a wireless transceiver configured for relatively short-range, low-power communications. In the first alarm, the processor drives the piezoelectric transducer in response to a signal from the machine controller and, also responsive to the machine controller signal, transmits a control signal via the wireless transceiver. In the second alarm, the wireless transceiver receives the control signal from the first alarm and supplies it to the processor, which is configured drive the piezoelectric transducer in response. The alarms are configured to work in tandem, when attached to each other, to cooperatively produce a combination of sound characteristics not achievable with either alarm alone. The alarms are also configured to detect when they are detached from each other and to respond by changing one or more sound characteristics. When detached, the alarms are also capable of affecting the operation of each other via two-way wireless communications.

22 Claims, 2 Drawing Sheets

(56) References Cited

U.S. PATENT DOCUMENTS

| | | | | |
|---|---|---|---|---|
| 5,163,447 | A | 11/1992 | Lyons | |
| 5,293,155 | A | 3/1994 | Nicol et al. | |
| 5,319,698 | A | 6/1994 | Glidewell et al. | |
| 5,386,479 | A | 1/1995 | Hersh | |
| 5,675,311 | A | 10/1997 | Burnett et al. | |
| 5,675,312 | A | 10/1997 | Burnett | |
| 5,793,282 | A | 8/1998 | Arnold et al. | |
| 5,872,506 | A | 2/1999 | O'Brien et al. | |
| 5,990,784 | A | 11/1999 | Burnett | |
| 6,009,320 | A | 12/1999 | Dudley | |
| 6,052,575 | A | 4/2000 | Lähdemäki et al. | |
| 6,115,478 | A * | 9/2000 | Schneider | 381/314 |
| 6,130,618 | A | 10/2000 | Burnett et al. | |
| 6,310,540 | B1 | 10/2001 | Burnett et al. | |
| 6,414,604 | B1 | 7/2002 | Burnett et al. | |
| 6,512,450 | B1 | 1/2003 | Burnett et al. | |
| 6,617,967 | B2 | 9/2003 | Baldwin et al. | |
| 6,756,883 | B2 | 6/2004 | Burnett et al. | |
| 6,963,737 | B2 | 11/2005 | Dörrer et al. | |
| 6,987,445 | B1 | 1/2006 | Burnett et al. | |
| 7,340,400 | B2 | 3/2008 | McGinn et al. | |
| 7,463,160 | B2 | 12/2008 | Crook | |
| 7,505,600 | B2 | 3/2009 | Dryer | |
| 7,584,743 | B2 | 9/2009 | Godbold | |
| 7,737,843 | B2 | 6/2010 | Belden et al. | |
| 7,880,593 | B2 | 2/2011 | Baldwin et al. | |
| 7,920,069 | B2 | 4/2011 | Shain et al. | |
| 2003/0030567 | A1 * | 2/2003 | Hetzel et al. | 340/815.4 |
| 2005/0219040 | A1 | 10/2005 | Dryer | |
| 2007/0057778 | A1 | 3/2007 | Prince et al. | |
| 2007/0190969 | A1 * | 8/2007 | Gray | 455/404.1 |
| 2010/0020166 | A1 * | 1/2010 | Levine et al. | 348/82 |
| 2010/0102940 | A1 | 4/2010 | Baldwin et al. | |
| 2010/0142738 | A1 | 6/2010 | Zhang et al. | |
| 2011/0012729 | A1 * | 1/2011 | Hess | 340/539.13 |
| 2011/0230161 | A1 | 9/2011 | Newman | |
| 2011/0241869 | A1 * | 10/2011 | Kiani et al. | 340/514 |
| 2012/0154141 | A1 | 6/2012 | Piccolo, III | |
| 2014/0036732 | A1 * | 2/2014 | Elliot et al. | 370/259 |

OTHER PUBLICATIONS

RE46C100 Piezoelectric Horn Driver Circuit Product Specification, © 2009 Microchip Technology Inc., 4 pgs.

RE46C101 Piezoelectric Horn Driver and LED Driver Circuit Product Specification, © 2009 Microchip Technology Inc., 4 pgs.

"Signaling Solutions," Rockwell Automation Publication 855-BR001C-EN-P, © 2010 Rockwell Automation, Inc., 8 pgs.

Maxim Application Note 4148, "Piezoelectric Tone Generation Using the MAXQ3210," Nov. 15, 2007, © Maxim Integrated Products, 6 pgs.

MAXQ3210 Data Sheet, "Microcontroller with Internal Voltage Regulator, Piezoelectric Horn Driver, and Comparator," Rev. 1; 5/06, © 2006 Maxim Integrated Products, 28 pgs.

Banner CL50 Column Light Data Sheet, P/N 145315 Rev. G, Dec. 21, 2012, Banner Engineering Corp., 7 pgs.

PATLITE ME-A/MES-A Signal Tower Data Sheet, undated, PATLITE Corporation, 1 pg.

PATLITE ME-A/MP Installation Manual, undated, PATLITE Corporation, 4 pgs.

* cited by examiner

WIRELESS TANDEM ALARM

BACKGROUND OF THE INVENTION

This invention relates to audible warning devices, and more particularly to audible warning devices for industrial machinery such as machine tools, other metalworking and material processing equipment, assembly line equipment, and the like.

SUMMARY OF THE INVENTION

The present invention provides a wireless tandem alarm having a first alarm configured for physical connection to an industrial machine having an electronic machine controller, and a second alarm configured for detachable connection to the first alarm or to the industrial machine. Each alarm has a housing, a piezoelectric transducer within the housing, a processor configured to drive the piezoelectric transducer in response to a control signal, and a wireless transceiver configured for relatively short-range, low-power communications. In the first alarm, the processor drives the piezoelectric transducer in response to a signal from the machine controller and, also responsive to the machine controller signal, transmits a control signal via the wireless transceiver. In the second alarm, the wireless transceiver receives the control signal from the first alarm and supplies it to the processor, which is configured drive the piezoelectric transducer in response.

The objects and advantages of the present invention will be more apparent upon reading the following detailed description in conjunction with the accompanying drawings.

DESCRIPTION OF PREFERRED EMBODIMENTS

Figure 1:
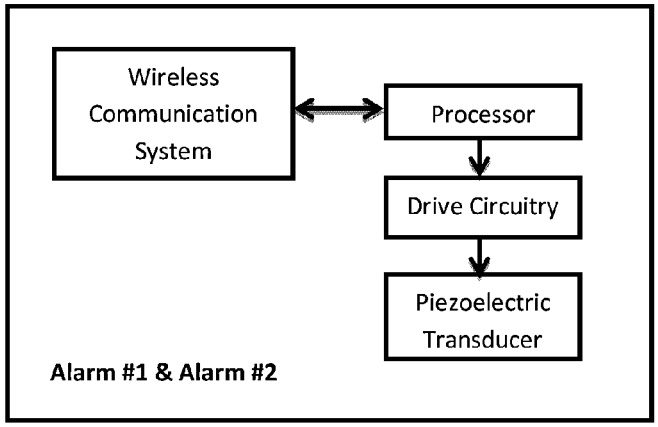
FIG. 1 is a block diagram of one embodiment of a wireless alarm according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

Referring to FIG. 1, Alarm #1 and Alarm #2 each contain a processor and a transceiver operatively connected thereto for two-way wireless communication. The processor is also connected via electronic drive circuitry to a piezoelectric transducer. The processor is capable of sending a signal to the drive circuitry which conditions it and then outputs a signal capable of driving a piezoelectric transducer to generate an audible sound. The wireless communication subsystem may consist of a collection of individual components or a pre-configured module such as a PAN1323 Series Bluetooth® RF module from Panasonic, and is preferably configured to operate at a frequency and power level conducive to short-range, low-power communications. The 2.4 GHz band is one example frequency range, and other commonly used wireless frequencies are also contemplated for use at relatively low power levels suitable for communication between devices over scores of feet, or over other distances within or between close factory buildings.

The processor, drive circuitry, and piezoelectric transducer may be as disclosed in U.S. Pat. No. 6,310,540, which is incorporated herein by reference along with all references cited therein, but other circuits using these three elements could also be used. The processor may alternatively drive the piezoelectric transducer directly, without the above drive circuitry, although the audible sound level with this arrangement may be too soft for industrial environments. Alarm #1 and Alarm #2 may also contain a switch or light indication such as described in U.S. patent application Ser. No. 13/327,089, filed Dec. 15, 2011, and incorporated herein by reference along with all references cited therein.

Figure 2:
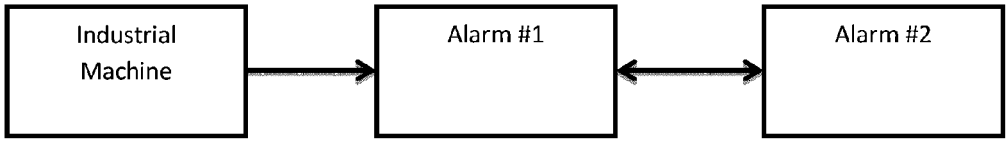
FIG. 2 is a block diagram of one embodiment of a wireless tandem alarm system according to the present invention.

Turning to FIG. 2, Alarm #1 is physically connected to an industrial machine which may be a machine tool, other metalworking or material processing equipment, assembly line equipment, or the like. The industrial machine is controlled by an electronic controller, and Alarm #1 is activated upon receiving an electrical signal from the industrial machine controller. The preferred embodiment is configured such that Alarm #1 receives power from the industrial machine via electrical wires, but Alarm #1 may instead be self-powered such as from a battery. It is also preferred to have control signals transmitted between Alarm #1 and the industrial machine controller via physical means such as electrical wires, but, alternatively, Alarm #1 may be configured to receive signals from the industrial machine controller wirelessly. For example, if both the industrial machine controller and Alarm #1 are configured to utilize IEEE Standard No. 802.15.4, then they can communicate with each other wirelessly.

Alarm #2 may be physically attached to Alarm #1, or mounted alongside it, but Alarm #2 is preferably detachable and still operable when detached, and for that purpose it has an internal power source such as a rechargeable battery. The processors of the two alarms have means of sensing whether they are attached or detached. The means could be as simple as a pushbutton switch that is engaged when Alarm #2 is physically placed against Alarm #1, one such switch being incorporated into Alarm #1 and integrated into the front of the alarm housing as disclosed in the above-referenced patent application Ser. No. 13/327,089, or it could be electronic such as processor-based detection of the strength of the wireless signal between the two alarms.

When the industrial machine controller sends an activation signal to Alarm #1, Alarm #1 activates Alarm #2 and the two alarms may respond in the same way or in different ways. For example, when they are attached, they can work in tandem to produce unique alarm sounds not possible with just one alarm. As one particular example, Alarm #1 could utilize a piezoelectric transducer with a resonant frequency of 1900 Hz, and Alarm #2 could utilize a piezoelectric transducer with a resonant frequency of 2900 Hz. Alarm #1 could issue a short audible beep and simultaneously send a signal to Alarm #2 which upon receiving the signal could delay and then issue a short audible beep, and this sequence of alternate beeping could repeat as long as the two alarms are activated and attached. The resulting audible sound would be described as a high-low or warble sound with a wide frequency spread and with equal sound level. With a single piezoelectric audible alarm, it is not possible to produce this kind of a warble sound with an equal sound level for two sound frequencies with 1,000 Hz difference.

When an operator detaches Alarm #2, the processors of one or both alarms can adjust for this fact and change the sound level, change the sound type, and/or activate an attached LED. For example, if Alarm #1 and Alarm #2 were configured to work together to make a warble sound while attached, when detached, Alarm #1 may change to issue a continuous sound that shuts off after 1 minute while Alarm #2 may issue a fast pulse sound that continues to sound until the machine controller initiates a command for the audible alarm pair to cease sounding. In another example, when Alarm #2 is detached from Alarm #1, the sound level of Alarm #2 may automatically be lowered which would be preferable if Alarm #2 is being taken to a quieter area or if it will be worn by or stay in close proximity to a person.

The processors and two-way wireless communication subsystems in Alarm #1 and Alarm #2 are configured to enable an operator at one alarm to affect the operation of one or both alarms. Each alarm may be provided with a control button for such purposes. For example, Alarm #1 is mounted to an industrial machine that is being monitored by an operator in the area. Alarm #2 is detached and near a second person who is in a remote area, but still within range of the wireless signal from Alarm #1. When the industrial machine controller detects a situation that requires an audible sound and activates Alarm #1, Alarm #1 begins sounding and sends a wireless signal to Alarm #2 which begins sounding. If the operator near Alarm #1 presses the button connected to Alarm #1, Alarm #1's processor detects the button push, mutes Alarm #1 and sends a wireless signal to Alarm #2. Alarm #2's processor receives the signal via the transceiver and, in response, mutes the sound for Alarm #2 and begins flashing an attached LED. Likewise, in the same situation, the person near Alarm #2 could push an attached button resulting in Alarm #1 muting and flashing an attached LED.

Figure 3:
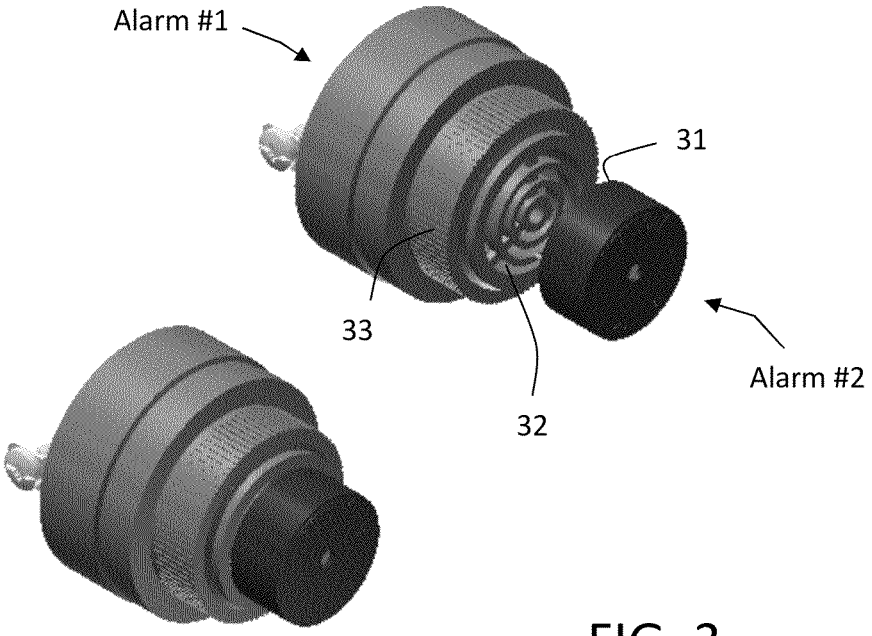
FIG. 3 depicts a tandem alarm pair in one example of a piggyback configuration.

FIG. 3 depicts the tandem alarm pair in a piggyback configuration as one desirable tandem alarm configuration. Alarm #1 is in a panel-mount package so that it can be secured to a control panel or the like on the industrial machine. Alarm #1 has screw terminals for power connections and for connection to signal lines of the industrial machine controller. Alarm #2 may be attached to Alarm #1 as shown on the lower left, or detached as shown on the upper right. An advantage of this configuration is to minimize the profile of the alarm tandem so that the least amount of physical space on the industrial machine is used. The rear end 31 of Alarm #2 may be provided with three, four or more equiangularly spaced thin rearward extending prongs sized and shaped to securely but detachably fit into the outermost annular slot 32 in the grille on the front of Alarm #1. An air gap may be provided between the piggybacked alarms to ensure an adequate outlet for the sound from Alarm #1. One way to provide such an air gap is to have four prongs, as described above, which are long enough that, when the alarms are attached, there is 2-10 mm of free longitudinal space between the forwardmost part of Alarm #1 (as seen on the upper right of FIG. 3) and the rearmost part of Alarm #2 (excepting the prongs themselves). As an alternative to the air gap, the sound cavity opening of Alarm #1 may be made larger to compensate for the attenuating effect of covering that opening with Alarm #2.

In one embodiment, Alarm #1 has a cylindrical cup formed on its front end as a friction-fit or snap-fit receptacle for Alarm #2 as it is depicted in FIG. 3. For example, the cylindrical cup may comprise a hollow longitudinal extension of cylindrical section 33 of Alarm #1, extending 2-10 mm beyond the forwardmost part of the grille. The extension may have front and rear cylindrical sections with different diameters, the front section dimensioned to mate with Alarm #2 and having a seat or stop on its inner wall to limit the travel of the body of Alarm #2 into the cup. The rear section preferably has an apertured or perforated sidewall to allow for the propagation of sound from Alarm #1 when Alarm #2 is attached.

In other embodiments, the two alarms have housings of the same size and/or shape, and may be the same in all respects except for the means of physical and electrical connection to the industrial machine. In cases where Alarm #1 is self-powered and has a wireless connection to the machine controller, the two alarms may be identical in size, shape and internal circuitry. In such cases, the alarms may be mounted in a piggyback configuration on an industrial machine control panel fitted with an elongate receptacle sized and shaped to slidably but securely receive both alarms, e.g., with a friction fit, with at least Alarm #2 detachably secured. Alternatively, the control panel may be fitted with adjacent receptacles for the two alarms, with at least Alarm #2 detachably secured in its receptacle. Alarm #2 is preferably readily detachable, not requiring any tools for detaching it from Alarm #1 or the machine.

Figure 4:
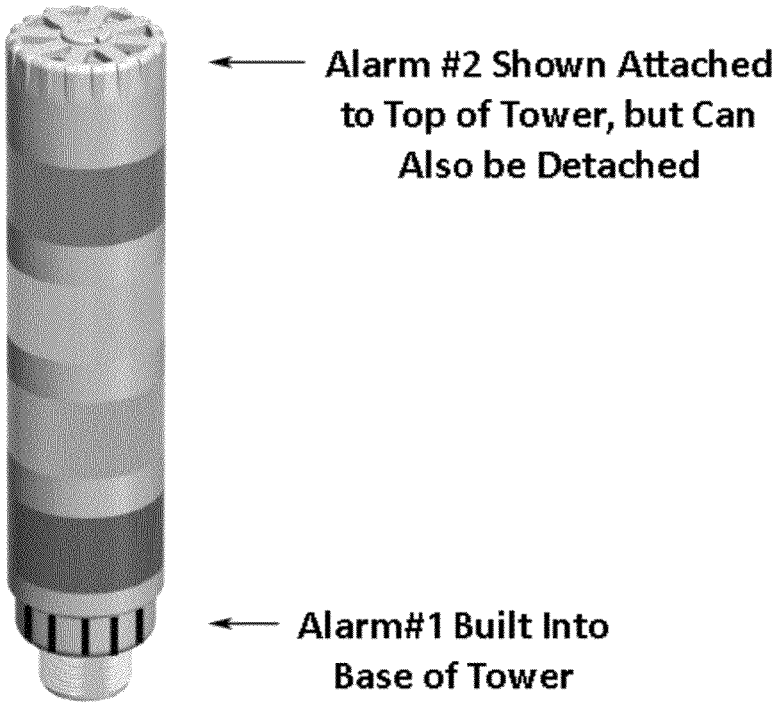
FIG. 4 depicts a tandem alarm pair in one example of a tower light configuration.

FIG. 4 depicts another alternative embodiment in which the tandem alarm pair is arranged in a tower configuration with lights. The tower is physically attached to an industrial machine. Alarm #1 may be permanently attached to the base of the tower and electrically connected to the machine via wires. On top of Alarm #1 are one or more light stacks controlled by the processor in Alarm #1. On the very top is Alarm #2 which can be attached or detached and carried remotely. Alarm #2 may also contain single LEDs which correspond to the same colors in the light stack. In this configuration, Alarm #1 and Alarm #2 are preferably programmed such that, when Alarm #2 is detached, the light stack attached to Alarm #1 and the LEDs attached to Alarm #2 both indicate the same colors.

This embodiment may be made using the Patlite MES-A 25 mm Series of signal towers modified to provide a threaded connection to a compatibly threaded top of Alarm #1. Alarm #2 is detachably attached to the top of the signal tower by means of another threaded connection, a snap-fit connection, or a hollow cylindrical coupler sized to have one end fit over the top of the cylindrical signal tower and the other end fit over the cylindrical base of Alarm #2 with a friction fit or other secure but detachable connection. A Banner CL50 Series column light may also be used, modified for mounting on top of Alarm #1 such as with a hollow cylindrical coupler or with other piggyback configurations as described above, and with Alarm #2 configured for threaded connection to the top of the tower as with the audible indicators available with the CL50 Series.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

We claim:

1. A wireless tandem industrial machine alarm, comprising:

a first alarm configured for physical connection to an industrial machine having an electronic machine controller, said first alarm having a housing, a piezoelectric transducer within said housing, a first processor configured to drive said piezoelectric transducer in response to a signal from the machine controller, and a first wireless transceiver configured for relatively short-range, low-power communications, said first processor further responsive to said machine controller signal to transmit a control signal via said first wireless transceiver; and a second alarm configured for detachable physical connection to said first alarm or to the industrial machine, said second alarm having a housing, a piezoelectric transducer within said housing, a second processor configured to drive said piezoelectric transducer in response to a control signal, and a second wireless transceiver configured for relatively short-range, low-power communications and configured to receive said control signal from said first wireless transceiver in said first alarm and supply said control signal to said second processor.

2. The wireless tandem alarm of claim 1, wherein said first and second alarms are configured to work in tandem, when attached to each other, to cooperatively produce a combination of sound characteristics not achievable with either alarm alone.

3. The wireless tandem alarm of claim 2, wherein at least one of said first and second alarms is configured to detect when they are detached from each other and to respond by changing one or more sound characteristics.

4. The wireless tandem alarm of claim 3, wherein said first and second alarms are capable, when detached, of affecting the operation of each other via two-way wireless communications.

5. The wireless tandem alarm of claim 4, wherein said first and second alarms have substantially the same package configuration and internal circuitry.

6. The wireless tandem alarm of claim 1, wherein at least one of said first and second alarms is configured to detect when they are detached from each other and to respond by changing one or more characteristics of the sound produced when said alarms are activated.

7. The wireless tandem alarm of claim 1, wherein said first and second alarms are capable, when detached, of affecting the operation of each other via two-way wireless communications.

8. The wireless tandem alarm of claim 7, wherein said first and second alarms have substantially the same package configuration and internal circuitry.

9. The wireless tandem alarm of claim 1, wherein said first and second alarms have substantially the same package configuration and internal circuitry.

10. The wireless tandem alarm of claim 1, further comprising a drive circuit in each alarm through which the processor drives its associated piezoelectric transducer.

11. The wireless tandem alarm of claim 1, wherein the processor in each alarm drives its associated piezoelectric transducer directly.

12. The wireless tandem alarm of claim 1, wherein said machine controller signal and said control signal transmitted via said first wireless transceiver have substantially the same format.

13. The wireless tandem alarm of claim 1, wherein said machine controller signal and said control signal transmitted via said first wireless transceiver have different formats.

14. A wireless tandem industrial machine alarm, comprising:

a first alarm configured for physical connection to an industrial machine having an electronic machine controller, said first alarm having a housing, a visual or audible indicator within said housing, a first processor configured to drive said indicator in response to a signal from the machine controller, and a first wireless transceiver configured for relatively short-range, low-power communications, said first processor further responsive to said machine controller signal to transmit a control signal via said first wireless transceiver; and a second alarm configured for detachable physical connection to said first alarm or to the industrial machine, said second alarm having a housing, a visual or audible indicator within said housing, a second processor configured to drive said indicator in response to a control signal, and a second wireless transceiver configured for relatively short-range, low-power communications and configured to receive said control signal from said first wireless transceiver in said first alarm and supply said control signal to said second processor.

15. The wireless tandem alarm of claim 14, wherein said indicator in at least one of said alarms is a piezoelectric transducer, further comprising a drive circuit in said at least one alarm through which the processor drives said piezoelectric transducer.

16. The wireless tandem alarm of claim 15, wherein said first and second alarms are configured to work in tandem, when attached to each other, to cooperatively produce a combination of sound characteristics not achievable with either alarm alone; and wherein at least one of said first and second alarms is configured to detect when they are detached from each other and to respond by changing one or more sound characteristics.

17. The wireless tandem alarm of claim 16, wherein said first and second alarms are capable, when detached, of affecting the operation of each other via two-way wireless communications.

18. The wireless tandem alarm of claim 17, wherein said first and second alarms have substantially the same package configuration and internal circuitry.

19. The wireless tandem alarm of claim 14, wherein said indicator comprises one or more LEDs.

20. The wireless tandem alarm of claim 19, wherein at least one of said first and second alarms is configured to detect when said alarms are detached from each other and to respond by producing a different output in response to activation than when said alarms are attached.

21. The wireless tandem alarm of claim 20, wherein said first and second alarms are capable, when detached, of affecting the operation of each other via two-way wireless communications.

22. The wireless tandem alarm of claim 21, wherein said first and second alarms have substantially the same package configuration and internal circuitry.

* * * * *